US006777877B1

(12) United States Patent
Wright et al.

(10) Patent No.: US 6,777,877 B1
(45) **Date of Patent: *Aug. 17, 2004**

(54) GUN-ONLY MAGNET USED FOR A MULTI-STAGE DEPRESSED COLLECTOR KLYSTRON

(75) Inventors: Edward L. Wright, Union City, CA (US); Richard J. Dobbs, Acton (CA)

(73) Assignee: Communication & Power Industries, Inc., Palo Alto, CA (US)

( * ) Notice: Subject to any disclaimer, the term of this patent is extended or adjusted under 35 U.S.C. 154(b) by 80 days.

This patent is subject to a terminal disclaimer.

(21) Appl. No.: 09/649,479

(22) Filed: Aug. 28, 2000

(51) Int. Cl.[7] ..... H01J 23/087; H01J 25/02
(52) U.S. Cl. ..... 315/5.35; 315/5.38
(58) Field of Search ..... 315/5.35, 5.38, 315/5.39

(56) References Cited

U.S. PATENT DOCUMENTS 3,702,951 A 11/1972 Kosmahl ..... 315/5.38
3,764,850 A * 10/1973 Kosmahl ..... 315/5.35 X
3,832,596 A * 8/1974 Nelson et al. ..... 315/5.35 X
4,387,323 A 6/1983 Berwick ..... 315/5.35
4,395,656 A * 7/1983 Kosmahl ..... 315/5.38 X
5,420,478 A 5/1995 Scheitrum ..... 315/5.38

FOREIGN PATENT DOCUMENTS

GB 2326274 12/1998 ..... H01J/23/06
JP 48151 * 4/1979 ..... 315/5.35

* cited by examiner

*Primary Examiner*—Benny T. Lee
(74) *Attorney, Agent, or Firm*—Thelen Reid & Priest, LLP; David B. Ritchie

(57) ABSTRACT

A klystron tube for amplifying signals at microwave radio frequencies utilizes an electron source for emitting electrons through a field focused by a high energy magnet in the RF section of the tube. After the electrons have passed through the active area of the tube, the electrons strike the collector which, in this case, is a multistage depressed collector. The multiple stages of the depressed collector are connected to high energy voltage sources of different potentials. The magnet used for focusing the electron beam is closed (no open pole pieces) at the multistage depressed collector so that no magnetic flux reversals are present to affect the beam dispersal, due to electrostatic space charge forces, onto the multistage depressed collector.

9 Claims, 8 Drawing Sheets

GUN-ONLY MAGNET USED FOR A MULTI-STAGE DEPRESSED COLLECTOR KLYSTRON

BACKGROUND

1. Technical Field

This invention relates to a permanent magnet focused multi-stage depressed collector (MSDC) klystron, and more particularly to a gun-only magnet for use in a MSDC klystron tube.

2. Description of Background Art

Klystron tubes are known devices used for high power transmission of microwave signals. Klystrons are used typically in terrestrial transmission of radio frequency signals, such as for VHF or UHF transmission of radio and television signals. Klystrons also have use in uplink paths in ground to orbiting satellite systems.

There is a continuing effort to make klystron tubes more efficient as well as smaller with the same or increased output power. Heat loss, as well as power loss due to inefficient tube operation, is under continuous scrutiny. Multi-stage depressed collector tubes have been discussed in the prior art. Marrying the MSDC technology in a high power uplink klystron tube has been an unreached goal.

Cost and efficiency are two major factors in the design and manufacture of high power regulator circuits. In addition, maximization of the circuit efficiency increases the value of the circuit. That is, while the circuit components may have a high relative cost, increasing the efficiency of the operation of the circuit offsets the initial cost of the circuit elements from the outset. Thus, a high power supply designer wants to maximize the efficiency of the circuit designed, keeping costs under control, while continuing to meet design criteria.

SUMMARY OF THE INVENTION

The present invention relates to a high power output vacuum electron device. The invention includes a cathode for emitting a supply of electrons and an anode for attracting the electrons, with the anode being constructed to allow the electrons to pass through the anode. An RF generator circuit in the path of the electron beam generates RF signal energy in the presence of a high voltage power source. A magnet surrounds the anode and the RF generation circuit for focusing the electrons into a collimated beam. A collector receives the collimated electron beam and returns the collected electrons to the cathode. The collector is a multi-stage depressed collector, which is shielded from the magnetic field from the magnet. The region of the collector is free of any magnetic fields so that the electron beam naturally disperses to evenly deposit the electrons on the inner walls of the collector. Another embodiment of the invention relates to a gun only magnet for use in a multi-stage depressed collector in a high-energy electron device. A first pole piece of the magnet generates magnetic flux adjacent a cathode of the vacuum electron device to drive and initially focus electrons emitted from the cathode. A second pole piece region of the magnet forms magnetic flux along the path of electrons to focus the electrons into a narrow beam, the magnet having no pole piece in the region of the vacuum electron device where the electrons are collected and returned to the cathode.

BRIEF DESCRIPTION OF THE DRAWINGS

For a more complete understanding of the embodiments of the invention herein, reference may be had to the following detailed description in conjunction with the drawings wherein.

Reference numbers refer to the same or equivalent parts of the present invention throughout the various figures of the drawings.

DETAILED DESCRIPTION OF THE INVENTION

Those of ordinary skill in the art will realize that the following description of the present invention is illustrative only and not in any way limiting. Other embodiments of the invention will readily suggest themselves to such skilled persons having the benefit of this disclosure.

Figure 10:
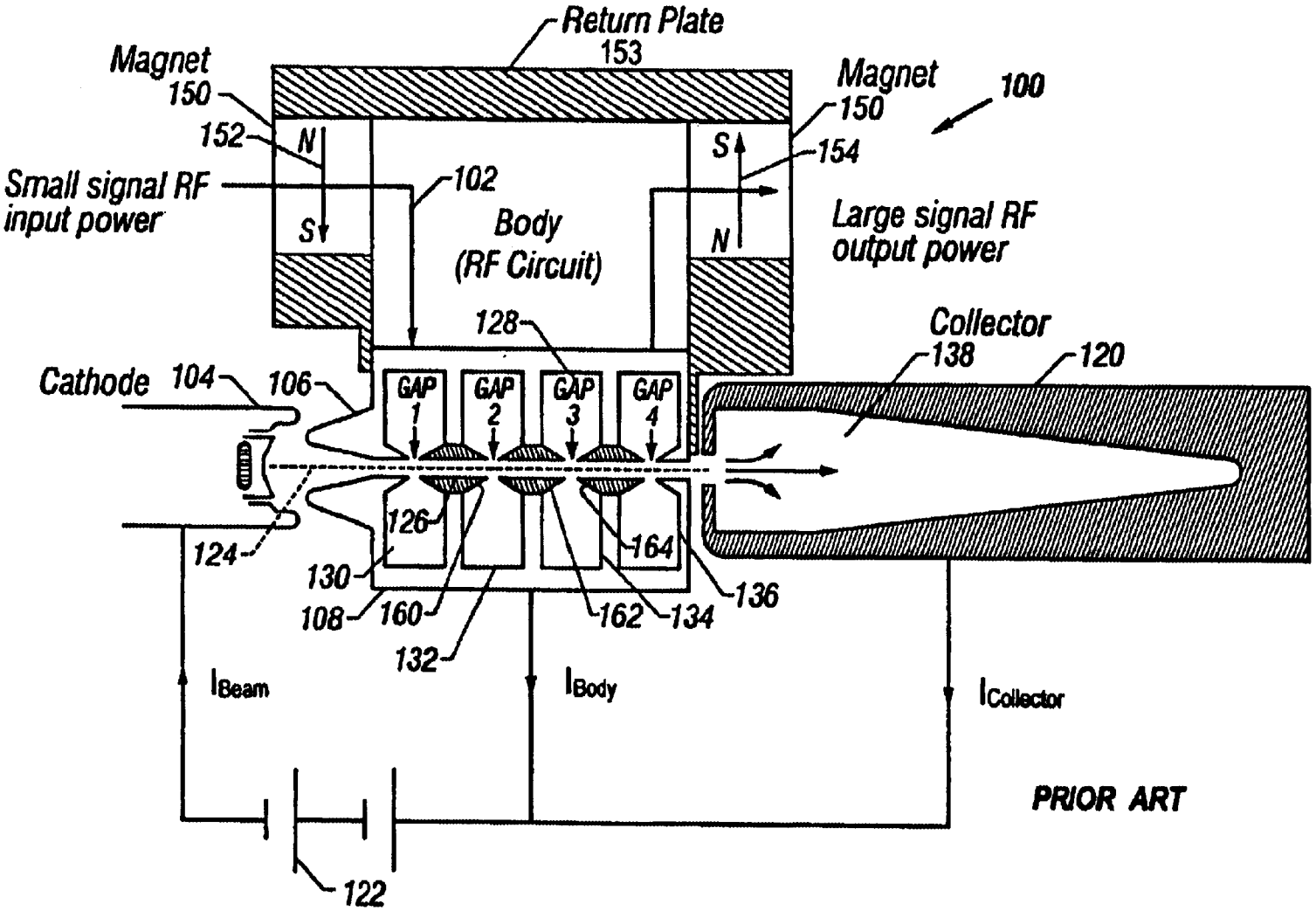
FIG. 10 is a side, schematic representation of a typical klystron tube.

The klystron tube 100 in FIG. 10 is a device for amplifying signals 102 at microwave radio frequencies. The high velocity electron beam emitted from the cathode 104 passes through the anode 106 and into the RF interaction region 108. An external magnetic field is employed to prevent the beam from spreading as it passes through the klystron. Magnet 150 supplies the strong magnetic field 152, 154 in a clockwise direction as FIG. 10 is viewed. Magnet 150 is cylindrical and surrounds parts of the cathode, anode, and parts of the collector, but only a top section view of the magnet is shown for clarity. A return plate 153 connects both magnetic fields 152 and 154. At the other end of the klystron, the electron beam impinges on the collector electrode 120, which dissipates the beam energy and returns the electron current to the beam power supply 122.

The electron emitter or cathode 104 is often referred to as an electron gun. Its purpose is to provide the beam of electrons 124 with a high kinetic energy. This kinetic energy will be partially converted to RF energy in the RF section of the klystron. The quality of the electron been is a fundamental determinant of the klystron operational effectiveness.

Cathode 104 emission (beam current 124) at a given beam voltage 122 is dependent on the surface temperature, which must be about 1050° C. to achieve the correct level of beam current. The beam shape will probably be incorrect if the surface is too cold, and the life of the tube is reduced if it is too hot. When the cathode has reached the required temperature for electron emission, a voltage is put across the cathode to anode spacing. This voltage causes the electrons to be accelerated towards the body assembly. The electron trajectories are electrostatically focused into a collimated beam when launched from the cathode. This electrostatic focusing is achieved through the careful shaped selection of a focus electrode and the anode electrode 106.

The repulsive force between the electrons in the beam will cause the beam to diverge. A magnetic field of the appropriate strength will keep the beam 124 collimated during its transit through the RF circuit. The magnetic field lines developed by the magnet must be parallel to the axis of the electron beam and the drift tubes 160, 162, 164 along the RF circuit so the electron beam will travel through the drift tubes in a straight line. A typical field strength requirement for a klystron utilized in an uplink satellite system may be in the range of 2500 to 5500 gauss.

The magnetic circuit, as part of magnet 150, surrounding the body of the klystron is typically comprised of four permanent magnets (gaps 1 to 4) mounted together with high-grade steel components. The structure is magnetized so that the magnetic flux from both halves of the circuit combine in parallel across the body gap.

After passing through the body assembly 108, the electron beam 124 has to be captured. The function of the collector 120 is to dissipate the energy of the electron beam 124 after it has passed through the output cavity. The collector is a shaped electrode that is typically shielded from most magnetic fields. As the beam leaves the body and enters collector 120, the absence of the magnetic field allows the beam to spread in chamber 138 due to the electrostatic 'space charge' forces. The beam strikes the collector surface and its kinetic energy is converted to heat. The heat is conducted to cooling fins and expelled with forced air cooling.

The RF interaction region 108, where the amplification occurs, contains resonant cavities 128 and field free drift spaces as guided by drift tubes 160, 162, 164. The first resonant cavity 130 encountered by an electron in the beam 124 is excited by the microwave signal 102 to be amplified, and an alternating voltage of signal frequency is developed across the gap.

An analogy can be made between a resonant cavity and a conventional LC circuit. The cavity gap corresponds to the capacitor, and the cavity walls volume to the inductance. If the cavity is just the right size, it will resonate at the desired frequency. At resonance, opposite sides of the gap becoming alternately positive and negative at a frequency equal to the microwave input signal frequency 102.

In the first cavity 130, the input signal 102 appears as a varying voltage across the drift tube tips which will accelerate or decelerate the electrons in the gap 126 depending on the polarity of the voltage at any given moment. This velocity modulation of beam leads to bunches of electrons. There are two bunching cavities 132, 134 that are tuned in such a way that the bunching is reinforced, increasing the RF energy carried by the beam. The output of the klystron 100 is a load on the output cavity 136 such that the beam is demodulated and the energy of electrons is transferred to the output signal.

Most klystrons utilize a standard large single collector for receiving the beam electron flow and returning it to the cathode. Such a klystron is typically shown in FIG. 10 as described above. The electrons ideally are introduced into the collector 120 and the intent is to eliminate the magnetic field in the collector to allow the electron beam 124 to disperse from its narrow beam due to the natural repulsive nature of each electron on the others. Once the electrons reach the collector chamber 138 with the magnetic fields its removed, the electrons should disperse and impinge on the internal walls of the collector chamber 138 and pass back to the cathode 104.

Figure 8:
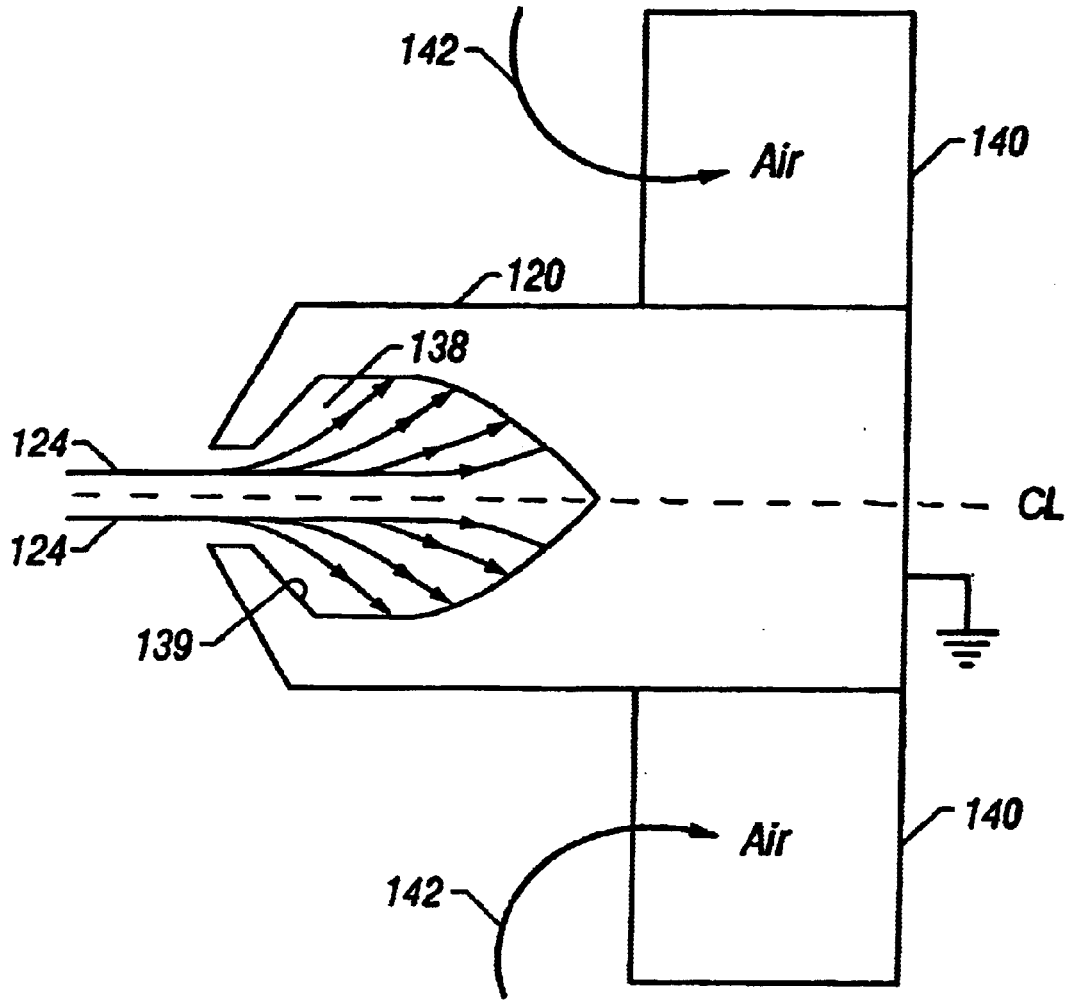
FIG. 8 is a side, schematic view of a klystron collector where electrons are entering the collector chamber in the absence of a magnetic field reversal.

In an ideal situation, the electron flow 124 enters the collector chamber 138 of the collector 120 with a centerline (CL) as seen in FIG. 8. As the electrons enter the chamber 138 and the magnetic field is removed, the natural electrostatic repulsion of the electrons will cause them to scatter to impinge upon the walls 139 evenly as shown internally of the chamber in FIG. 8. The fins 140 are shown for cooling, with air 142 forced over the fins 140 to remove the heat caused by the energy of the impinging electrons being converted from kinetic energy to heat energy.

Figure 9:
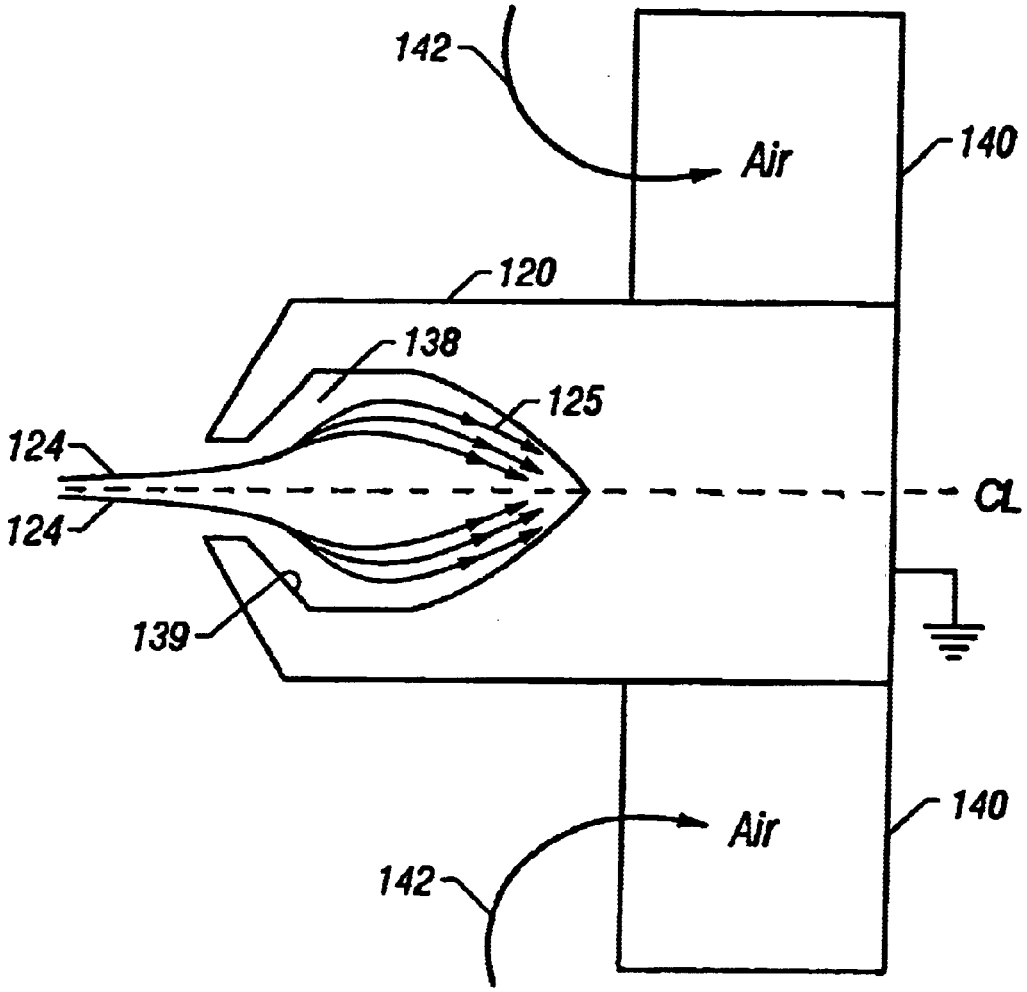
FIG. 9 PRIOR ART
FIG. 9 is a side, schematic view of a klystron collector where electrons are entering the collector chamber in the presence of a magnetic field reversal.

In an actual collector for a klystron, there is normally some extraneous magnetic field action within the chamber 138 defined internally of the collector 120 with a centerline (CL) as seen in FIG. 9 no matter how effective the shielding. FIG. 9 illustrates the walls 139 of the chamber 138. The fins 140 are also shown for cooling with air 142 forced over the fins 140 to remove the heat caused by the energy of the impinging electrons being converted from kinetic energy to heat energy. While it is not intended generally for the chamber 138 of the klystron collector 120 to be affected by the magnetic field, the prior art has not been successful in eliminating the effects of the magnetic flux reversal at the point where the electron beam enters the chamber 138 of the collector 120. The electron path 124 in FIG. 9 does not result in a pure fan shaped dispersion of the electron beam as seen in FIG. 8, but the electrons have a tendency to be refocused again within the collector chamber 138 by the flux reversals of the magnetic field, although unintended. FIG. 9 shows that the electron beam 124 become refocused electron beams 125 in the collector 120. The refocused electron beam 125 are collected in a smaller area of the chamber, shown to be accumulated at the inner end of chamber 138. With the electrons impinging on the collector in a smaller area, a designer must take into effect the possibility of hot spots caused by an over abundance of impinging electrons in that one area.

Another technique for improving the collection of electrons in high energy tubes in order to disperse the heat more efficiently and to recover more energy from the electron beam is to use a multistage depressed collector (MSDC). In the "Proceedings of the IEEE", Volume 70, No. 11, Nov., 1982, multistage depressed collectors were discussed for use in high energy tubes. In a multistage depressed collector tube, separate collectors in series in the collector area of the tube are connected to high energy voltage sources of different potentials in order to intercept electrons of various kinetic energies. That is, with the independent collectors receiving predetermined energy electrons, the heat caused by electron impingement is spread out among the separate collectors. However, the effects of the magnetic field reversals of the magnetic field in the area of the multistage collector are still manifest.

Figure 1:
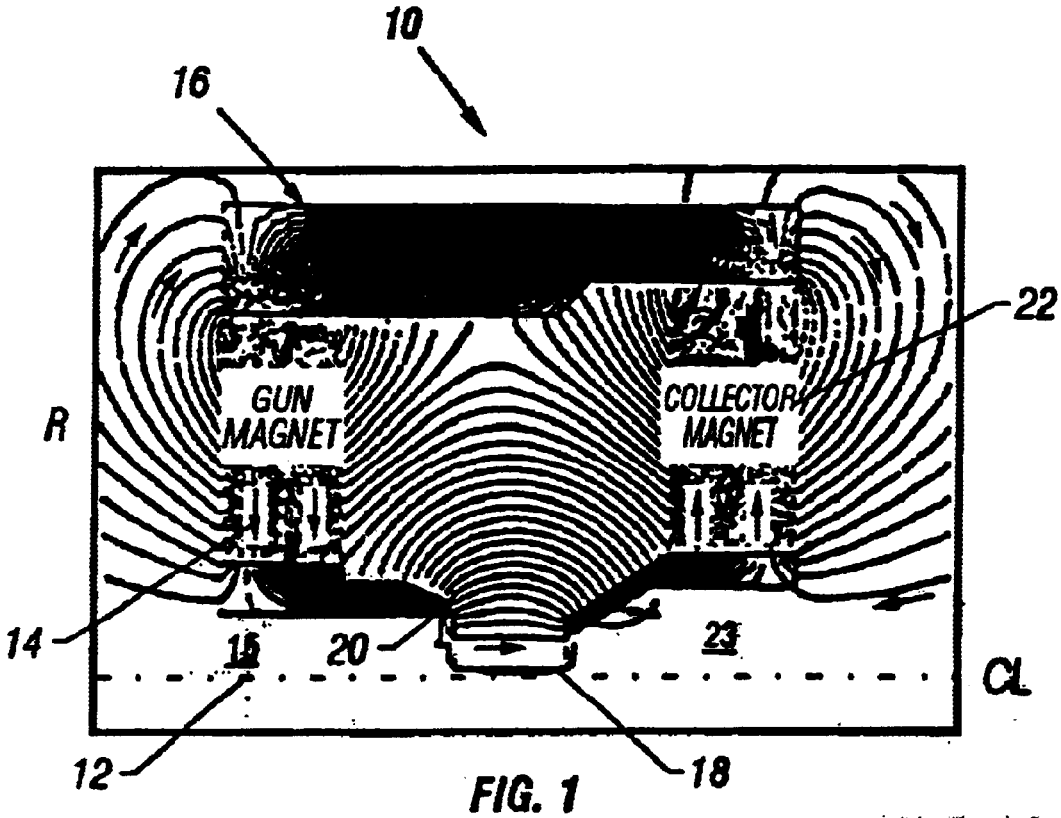
FIG. 1 PRIOR ART
FIG. 1 is a schematic diagram of a section through a conventional permanent magnet system used on a klystron tube.

FIG. 1 shows a conventional permanent magnet arrangement 10 for use in a typical klystron tube. The line 12 at the bottom of FIG. 1 is actually the centerline (CL) of the magnet depicted. That is, the magnet 10 shown in FIG. 1 is actually circular about the centerline with only a plan section view of one-half of the magnet illustrated. The vertical axis of FIG. 1 represents the dimension or radius (R) of the magnet 10. On the left side of the magnet is the area 14 of the magnet that is used to initially begin the focusing of the electron beam into a narrow pencil beam. The direction of the magnetic field at the area of the magnet adjacent the gun magnet 16 is toward the bottom of the magnet with the magnetic fields returning in the drawing to the other pole of the magnet at the top of FIG. 1. The electrons are confined along the centerline 12 of the high-energy tube by the magnetic flux field allowing for improved energy recovery of the electron beam.

As the electron beam moves from left to right, the permanent magnet 10 also has a magnetic field 18 which traverses the opening 20 at the area where the electron beam is modulated in order to generate the desired high energy microwave signal. As the electrons continue moving past the active part of the high energy tube, the electrons enter the collector region 22 for collection of the electrons as described above. Here also the magnetic field at the collector area has the magnetic field in the opposite direction so that the magnetic field passes upwards from one pole to the other and circulates in a clockwise direction as shown in FIG. 1.

Figure 2:
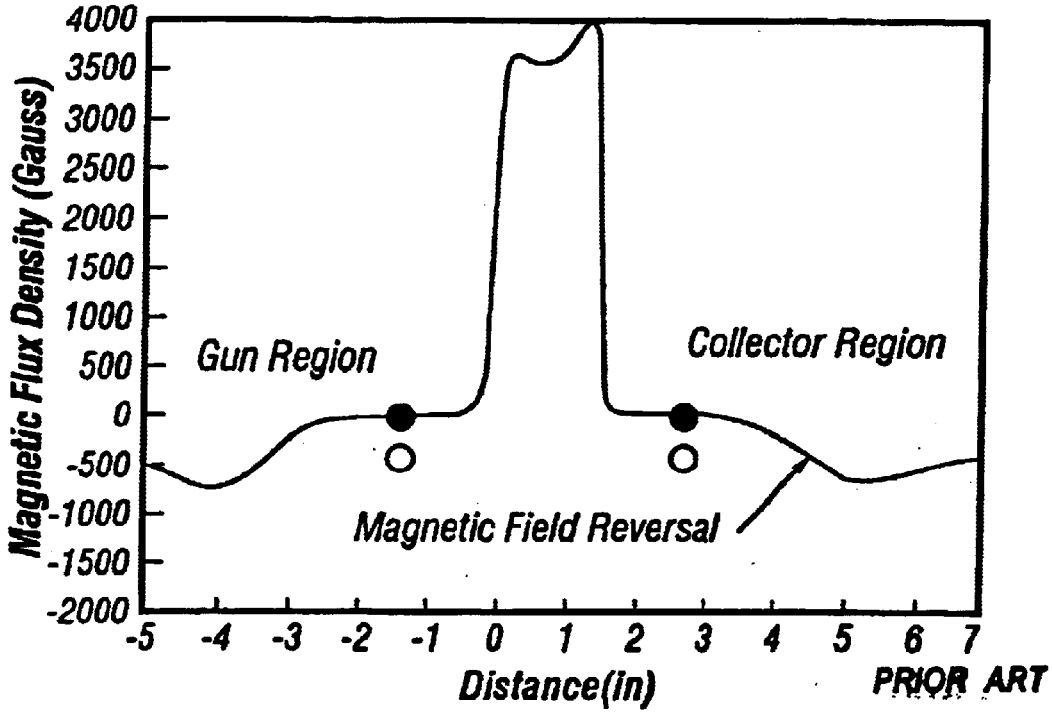
PRIOR ART FIG. 2
FIG. 2 is a drawing of magnetic flux density versus distance along the centerline of the axis of a conventional permanent magnet on-axis klystron tube.

FIG. 2 is a curve outlining the magnetic flux density of the magnet 10 described above in conjunction with FIG. 1. On the left in FIG. 2, the magnetic field begins the focusing effect of the magnetic field on the electron beam. As the electron beam passes the active energy section 18 of the tube, the effect of the two magnetic fields is highest there, as intended, in order to generate as much RF energy as the tube is designed for. As the electron beam continues to the right in FIG. 2, mirroring FIG. 1, the electron beam passes through a period of zero magnetic reversal. However, as the electron beam enters the collector region 22, the magnetic field imparts an unwanted magnetic effect on the electron beam as it enters the chamber of the collector. This magnetic field reversal is undesired at this point because, as set forth above, it is desirable that at this point in the electron beam path, all magnetic fields be removed so that the natural electronic field dispersion of the electrons can be effected within the opening in the collector so that the electrons can be evenly dispersed on the inside surface of the collector.

Figure 3:
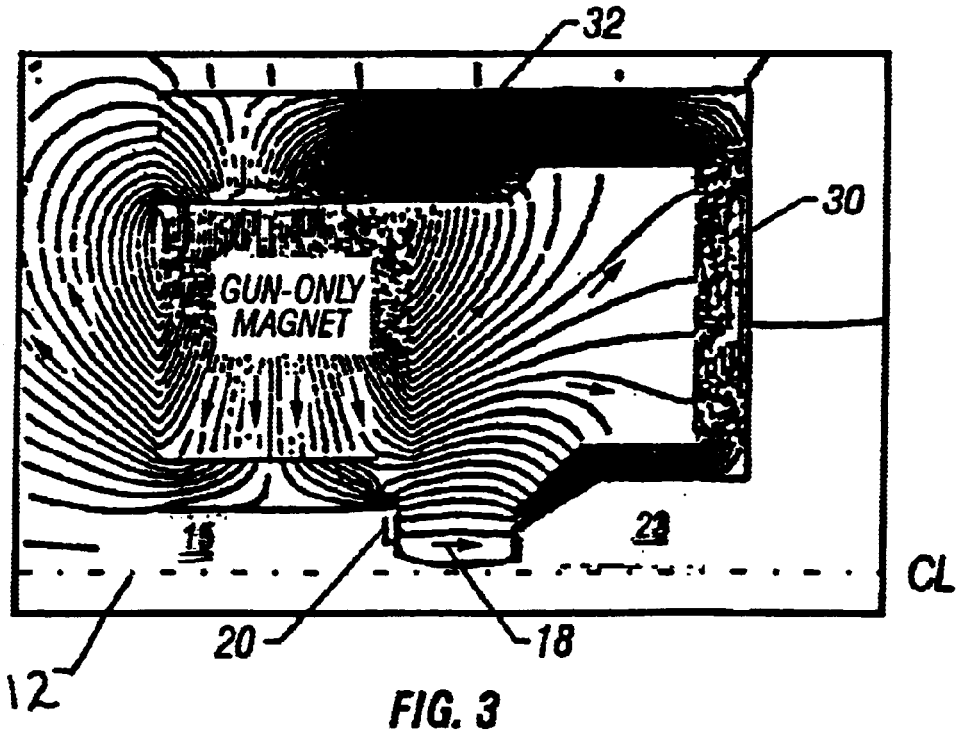
FIG. 3 is a schematic diagram of a section through a gun-only permanent magnet system in accordance with the present invention.

FIG. 3 shows a similar drawing to that of FIG. 1, except now there is magnetic material at the collector region 30 of the permanent magnet 32. The permanent magnet 32 has a magnetic field 18 which traverses the opening 20 at the area where the electron beam is modulated. This magnetic material eliminates the effects of any flux reversal which appeared and was described above conjunction with FIGS. 1 and 2. In FIG. 3, the magnetic field lines are terminated into the magnetic metal of the magnet at collector region 30.

Figure 4:
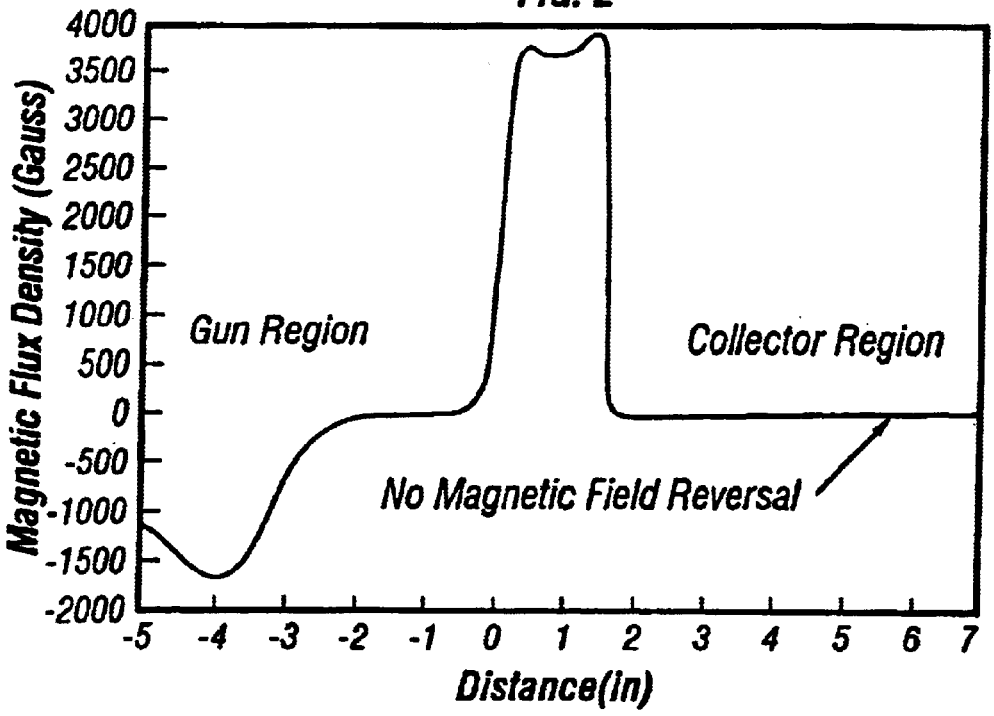
FIG. 4 is a drawing of magnetic flux density versus distance along the centerline of the axis of a gun-only permanent magnet on-axis klystron tube as described in conjunction with FIG. 3.

As the electron beam passes by the magnetic field 18 at the active opening 20 of the permanent magnet 32, it is seen in FIG. 4 that no magnetic field reversal is present now at the collector region 30 of the tube because of the closed portion of the magnet. This is highly desirable, as set forth above, because the electrons now are free to disperse within the opening in the collector to more evenly disperse the heat and to more accurately recover the kinetic energy of the electrons. See FIG. 8.

Figure 5:
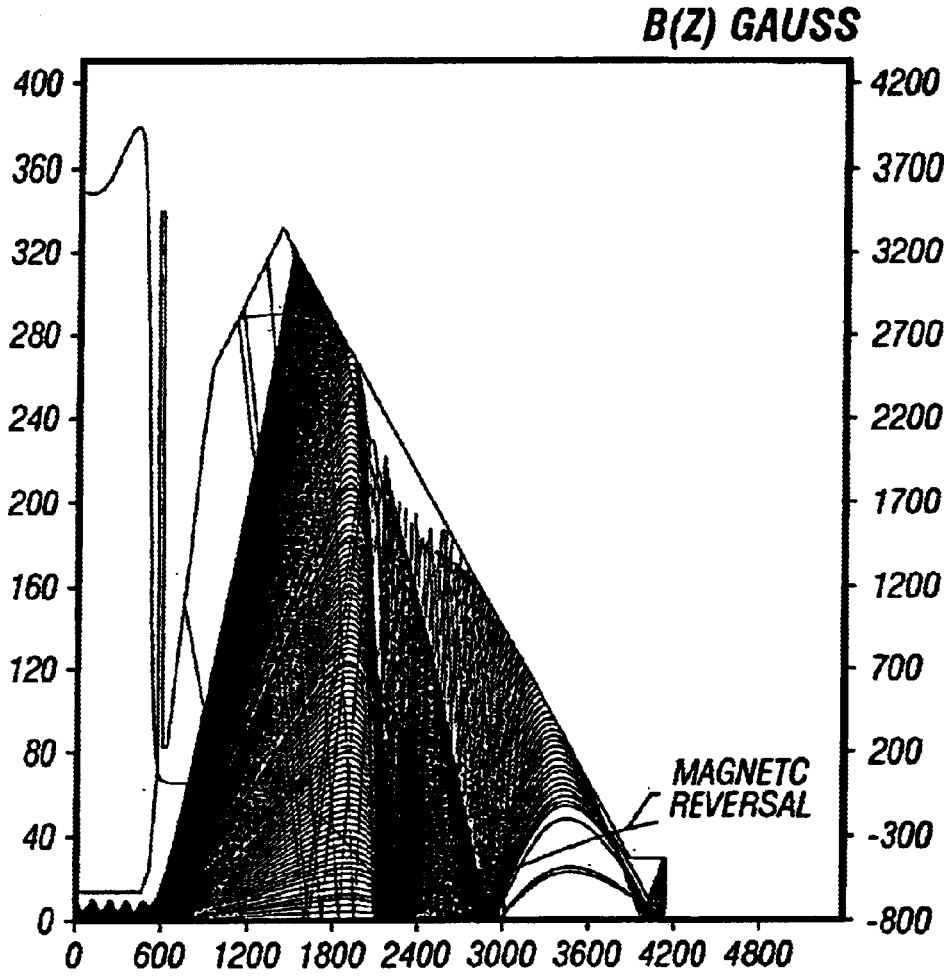
FIG. 5 PRIOR ART
FIG. 5 is a drawing simulation of electrons entering the collector region in the presence of a magnetic field reversal for a system as set forth in conjunction with FIG. 1 in accordance with a prior art.

FIG. 5 is a simulation of electrons entering the collector region in the presence of a magnetic field reversal system. This figure shows the magnetic field reversal and its effect on the electron field as it enters a single chamber high energy tube collector. Again, the horizontal radius is the centerline of the high energy tube and the fugure is only a slice through the upper part of the collector chamber. In actuality, FIG. 5 would be three-dimensional and occupy a space below the centerline as well as above, and in the circular shape in viewing the electron tube along the centerline itself. Some electrons do not make it to the walls of the collector region and are refocused by the magnetic flux reversals. Those that do not make it to the wall of the collector chamber may be focused once before collection. These particles would cross the centerline at least once. Some electrons would be refocused twice and cross the centerline twice before being collected. The plot in FIG. 5 shows many of the electron particles, some crossing the center line axis once and others many times.

Figure 6:
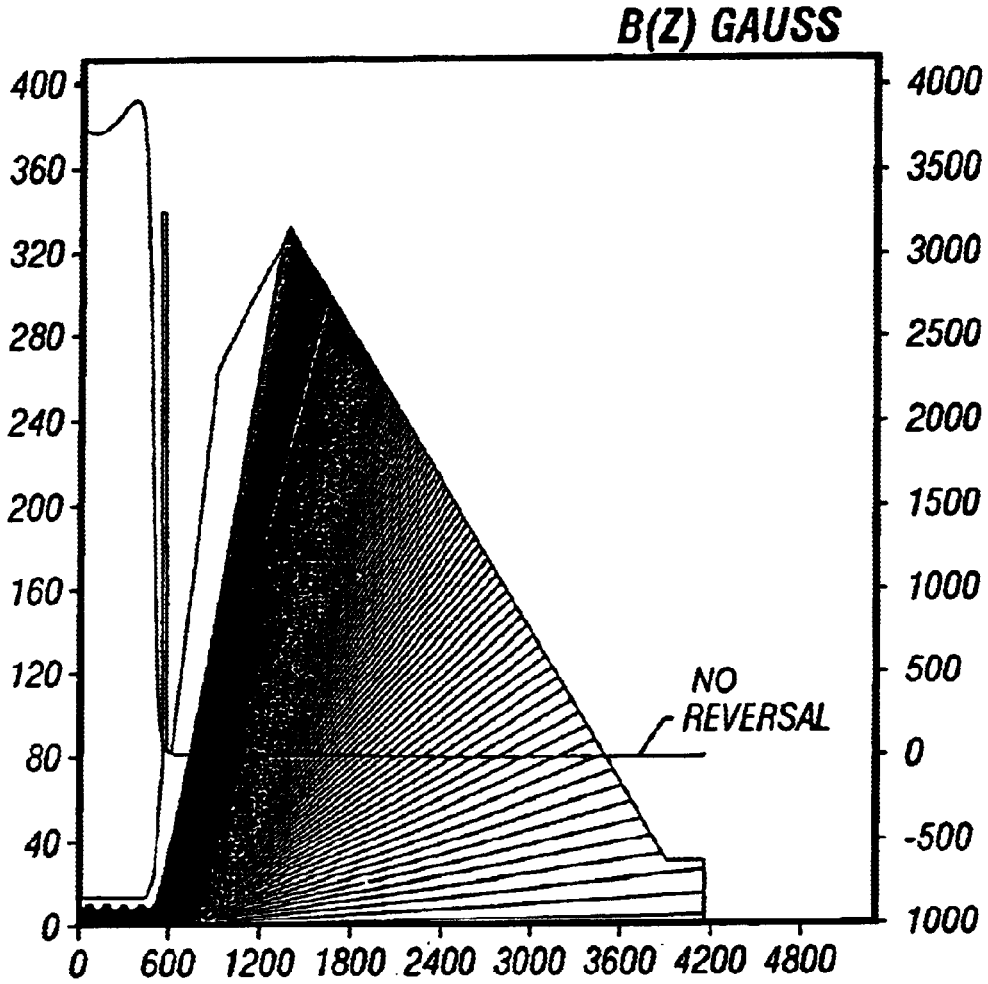
FIG. 6 is a drawing simulation of electrons entering the collector region in the absence of a magnetic field reversal in a gun-only permanent magnetic system as set forth in conjunction with FIG. 3.

FIG. 6 is a simulation of electrons entering the collector region in the absence of a magnetic field reversal by the use of a gun only magnet in accordance with the principles of the present invention. That is, since there is no magnetic flux reversal in this FIG., the electrons, as they enter the collector region chamber, are dispersed in accordance with the natural electrostatic repulsion of one electron to the other; and the electrons impinge on the wall of the collector chamber in a more or less even manner. This allows for an even dispersion of the heat energy and decreases the amount of hot spots and pitting caused by the electron impingement in the collector.

Figure 7:
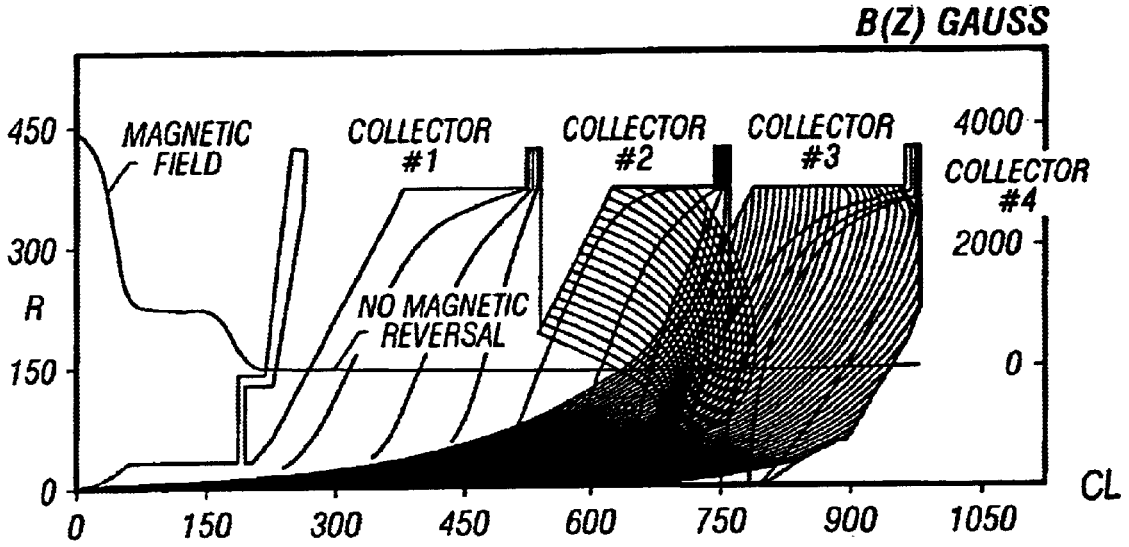
FIG. 7 is a drawing simulation of the electrons entering the collector region in the absence of a magnetic field reversal in a gun-only permanent magnet system utilizing a multistage depressed collector.

FIG. 7 is a simulation of electrons entering the four stage multistage depressed collector. As shown in FIG. 7, the electrons enter from the left, as the centerline (CL) of the tube is shown as the horizontal axis in the FIG. The vertical axis is the dimension of the actual copper forming the various four stages of the multi-stage depressed collector. The magnetic field is seen, as well. The equal potential lines are seen and the magnetic lines at collector stages 1, 2, 3, and 4 are horizontal indicating no flux reversal. Thus, the pattern of the electrons impinging upon the various stages of the collector in this multi-stage depressed collector is even as intended so that the heat is more adequately dispersed and the problem of hot spots is eliminated.

While embodiments and applications of this invention have been shown and described, it will be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A high power output vacuum electron device comprising:

a cathode for emitting a supply of electrons, an anode for attracting said electrons, said anode having a configuration to allow said electrons to pass through said anode, an RF generator circuit in the path of said electron beam for generating RF signal energy in the presence of a high-voltage power source, a magnet including a magnet pole piece surrounding said anode and said RF generation circuit for focusing said electrons into a collimated beam, and a collector for receiving the collimated electron beam and for returning the electrons to the cathode, said collector is a multi-stage depressed collector which is shielded provided by the magnetic field from said magnet, wherein said magnet includes no magnet pole piece in the vicinity of a region of, said collector, a magnetic material surrounding the collector region being disposed such that substantially no magnetic field reversal is present at the collector region.

2. The vacuum electron device of claim 1 wherein said of said collector a region is free of any magnetic fields such that the electron beam naturally disperses to evenly deposit said electrons on inner walls of said collector, said collector being thereby free of hot spots due to uneven electron deposition thereon.

3. The vacuum electron device of claim 1 wherein said collector region free of magnetic flux reversals causes the electron beam to evenly disperse in said collector.

4. The vacuum electron device of claim 1 wherein the magnetic field includes a refocusing region in the vicinity of an entrance to said collector region.

5. A vacuum electron device including a source of electrons, said electrons being configured into a narrow beam, and a multi-stage depressed collector for collecting said electrons, the improvement comprising:

a magnet arrangement surrounding and focusing said narrow beam, the magnetic flux of said magnet arrangement being parallel to and collinear with the centerline of said electron beam, said magnet arrangement having a first open pole piece adjacent to the area of said source of electrons to initially focus said electron beam, and a second open pole piece along said centerline to focus and drive said electron beam, said magnet having no open magnet pole piece in the vicinity of said multi-stage depressed collector so that any magnetic flux from the magnet is directed back into said magnet arrangement, and a magnetic material surrounding the multi-stage depressed collector such that substantially no magnetic field reversal is present at the multi-stage depressed collector.

6. The vacuum electron device of claim 5 wherein said multi-stage depressed collector includes an internal chamber, said electrons evenly dispersing within said internal chamber due to said multi-stage collector having substantially no magnetic field reversal, thereby eliminating any hot spots within said internal chamber.

7. The vacuum electron device of claim 6 wherein each stage of said multi-stage depressed collector is connected to a different high-voltage supply such that electrons of different kinetic energies will impinge on the associated depressed collector.

8. The vacuum electron device of claim 5 wherein said magnet arrangement further generates a refocusing magnetic field in the vicinity of an entrance to said region of collected electron.

9. A gun only magnet utilized in a multi-stage depressed collector high-energy vacuum electron device comprising:

a first pole piece region generating magnetic flux adjacent a cathode of said vacuum electron device to drive and initially focus electrons emitted from said cathode, a second pole piece region providing magnetic flux along the path of electrons to focus said electrons into a narrow beam, said magnet having no pole magnet piece in the region of said vacuum electron device where the electrons are collected and returned to said cathode, and a magnetic material surrounding the region of collected electron such that substantially no magnetic field reversal is present at the region of collected electron.

* * * * *

UNITED STATES PATENT AND TRADEMARK OFFICE

CERTIFICATE OF CORRECTION

PATENT NO. : 6,777,877 B1
DATED : August 17, 2004
INVENTOR(S) : Wright et al.

It is certified that error appears in the above-identified patent and that said Letters Patent is hereby corrected as shown below:

Column 6,
Line 62, before “the magnetic field”, replace “provided by” with -- from --.
Line 62, after “the magnetic field” replace “from” with -- provided by --.

Column 7,
Line 1, after “The vacuum electron of claim 1 wherein said,” insert -- region --.
Line 2, after “said collector” delete “a region”.

Column 8,
Line 16, replace “electron.” with -- electrons. --.

Signed and Sealed this

Ninth Day of August, 2005

JON W. DUDAS
*Director of the United States Patent and Trademark Office*